US005597362A

United States Patent [19]

Lee et al.

[11] Patent Number: 5,597,362

[45] Date of Patent: Jan. 28, 1997

[54] INTERCHANGEABLE AND ADJUSTABLE PUTTER

[76] Inventors: Young J. Lee, 3519 Maple Leaf Dr., Glenview, Ill. 60025; Backchul Shin, 142 Kenlock St., Libertyville, Ill. 60048

[21] Appl. No.: 651,678

[22] Filed: May 21, 1996

[51] Int. Cl.[6] ..... A63B 53/06

[52] U.S. Cl. ..... 473/244; 473/248; 473/307; 473/313

[58] Field of Search ..... 473/244, 245, 473/246, 248, 247, 288, 305, 307, 282, 313, 314, 340, 251, 238; 403/83, 84, 88, 119, 161, 93, 94, 95

[56] References Cited

U.S. PATENT DOCUMENTS

| | | | |
|---|---|---|---|
| 651,920 | 6/1900 | Cushing | 473/245 |
| 1,313,504 | 8/1919 | Rolfe | 473/246 |
| 1,549,265 | 8/1925 | Kaden | 473/245 |
| 2,477,438 | 7/1949 | Brouwer | 473/245 |
| 3,477,720 | 11/1969 | Saba | 473/245 |
| 3,931,969 | 1/1976 | Townhill | 473/246 |

FOREIGN PATENT DOCUMENTS

| | | | |
|---|---|---|---|
| 12200 | 5/1912 | United Kingdom | 273/79 |
| 23839 | 10/1914 | United Kingdom | 273/79 |
| 452305 | 8/1936 | United Kingdom | 273/79 |

*Primary Examiner*—Sebastiano Passaniti
*Attorney, Agent, or Firm*—Michael G. Berkman

[57] ABSTRACT

A golf club useful as a putter and including an elongate club shaft terminating at a lower end in a coupling structure for attachment to a cooperating coupling carried by an upper end of a stub shaft of any of a family of selectable putter heads. In the illustrated embodiment of the invention, the club shaft carries a yoke, and the stub shaft of the club head carries a disc. The disc is slideably received between spaced parallel plates of the yoke. A hinge-like camming lever is pivotal to draw the plates of the yoke together to lock and to secure interference-faced surfaces of the disc and the plates together to establish selectable, vertical angular attitudes of the club head, to meet a golfer's particular preference or needs.

7 Claims, 2 Drawing Sheets

INTERCHANGEABLE AND ADJUSTABLE PUTTER

FIELD AND BACKGROUND OF THE INVENTION

The present invention relates to an adjustable golf club. More particularly, the invention is directed to a golf putter in which the head of the club is pivotal to assume selectable vertical angles to meet the specific needs and preferences of a golfer.

Adjustable golf clubs are known in the art. In some examples, the head has been made pivotal to provide adjustable loft angles. In others, the head itself is replaceable with a head of a different configuration. In still others, the shaft of the club has been made adjustable to change the angle with respect to the head. Some golf clubs provide the option of using two different club faces in striking the golf ball. Yet other clubs are formed with means for varying the length of the club shaft.

Putters have received special attention. Provisions have been made to render available two different striking faces for the club. In other arrangements weights have been added to increase the mass of the head or to shift the center of gravity. In yet other putters special attention has been given to off-sets of the shaft with respect to the head. Other putters include structures rendering the putter head readily reversible to accommodate both right-handed and left-handed golfers.

Also known are golf putters which include mechanisns for varying the vertical attitude or angle between the club shaft and the head. In yet other arrangements, adjustments of the head with respect to several axes have been offered as a means to "customize" the club. Many of these structural arrangements are complex in execution, and expensive to produce. Another objection to "adjustable" heads and shafts of golf putters is the need for tools with which to make the adjustments and to lock the assembly fixed, as adjusted.

It is, therefore, the aim of the present invention to provide a golf putter in which the angular orientation of the club head may be pivitally adjusted, incrementally, in a vertical plane, and firmly locked in readily selectable positions quickly and secured positively, and without any need for tools. A related aim is to provide a golf putter in which the head itself may be quickly and conveniently replaced or substituted, again, without the use of tools.

SUMMARY OF THE INVENTION

An important feature of the present invention is that it provides a golf putter in which the elevation angle can be adjusted through selectable vertical angular attitudes about an axis in a plane which is parallel to a plane in which the shaft of the golf club projects, and that re-positioning and re-locking of the head of the putter is achieved simply and quickly without the use of any tools.

A related feature of the invention is that the head of the putter is integrally formed with an upwardly projecting stub shaft terminating in an upwardly extending, generally flat, disc-like projection defining an open hook. The hook itself is operational to accept therewithin a horizontally supported pin carried by the arms of a downwardly-opening yoke which is secured to and extends downwardly from the shaft of the golf club.

In a preferred embodiment of the invention the arms of the yoke define a pair of parallel plates spaced laterally to receive the club-head-supporting disc-like hook therebetween, as the hook engages the yoke-supported pin.

A critical feature of the invention is the provision of a digitally-manipulable and controllable assembly for compressingly, positively securing the disc-like hook of the club-head-carried stub shaft fixedly locked within the yoke in selectable, arcuately or angularly displaced angles or attitudes to establish a desired elevational angle of the base of the putter head.

An important component of the present invention is an assembly for acting mechanically on the arms of the yoke to urge the arms toward one another to bear upon the hook-like disc to lock the disc firmly between the arms of the yoke at selectable rotative positions of the disc.

A feature of the invention is a locking mechanism including a threaded rod which extends through the arms of the yoke and through the slot in the hook-defining disc. A second component of the locking assembly is a tensioning nut which is threaded on one end of the threaded rod to limit free longitudinal shifting of the rod through the yoke and disc components. A third component of the asserribly is a pivotally-hinged locking and release lever carried by the threaded rod at an end thereof remote from the tensioning nut to act upon the yoke to establish, selectively, a locking and a freeing mode of the yoke-sandwiched disc.

A related feature of the locking assembly of the invention is that the locking lever is carried by a pivot pin or hinge pin secured in a pair of spaced arms of the lever and passing through a flattened end of the threaded rod. The pin, about which the locking lever is rotatable, is eccentrically positioned with respect to the generally circular arms of the lever so that rotation of the lever causes the arms thereof to impress varying, controllable forces against an adjacent plate-like arm of the yoke to effect a compression of the yoke laterally, and to lock the disc of the club head fixed between the stressing plates of the yoke, to secure the club head at selectable vertical angles.

In the embodiment of the invention illustrated, the locking assembly is "unlocked" when an elongate body of the locking lever is disposed to extend outwardly from the club shaft and generally normally thereof. In a locking mode of the assembly, the hand-manipulated, elongate, lever-like body of the locking lever overlies and extends generally parallel to the club shaft.

It is a feature of the invention that the arms of the locking lever are arcuate in peripheral contour in a sector bearing against an adjacent plate of the yoke, and that upon pivotal rotation of the locking lever through an arc about the linking or hinge pin to effect a locking mode of the assembly, the edges of the arms of the lever are brought to bear against the adjacent plate of the yoke so as to impress increasing forces as the locking lever draws upon or pulls the threaded rod axially toward the hing pin of the assembly.

A related feature of the invention is the provision of a threaded tensioning nut on that end of the threaded shaft remote from the locking lever, the nut being rotatable effectively to reduce the effective length of the threaded shaft, thereby to generate increased force against the yoke when the locking lever is pivoted to establish a locking mode of the assembly.

Yet another feature of the invention comprises the provision of physical irregularities, hatching or scoring, or roughening on the surfaces of the hook-like linking element attached to the club head and on the faces of the abutting sandwiching plates of the yoke, thereby to establish mechanical interference and physical interengaging or locking between the abutting surfaces to deter slippage, and to enhance the stability and the mechanical unity, rigidity and integrity of the device in use.

In the specific embodiment of the invention illustrated, the arms of the locking lever are arcuate at the periphery of their functional edges, and the pivot pin through the arms is off center. As the arms are rotated to establish an upwardly extending attitude of the elongate body of the locking lever, the functional edges of the arms move eccentrically to travel farther and farther inwardly toward and against the adjacent plate of the yoke in which the hook-like disc is confined.

It is a related feature of the invention that the face of that yoke plate presented to the stressing curved ends of the arms of the locking lever is formed with a crater-like depression or is dished for receiving therewithin abutting arcuate sectors of the locking lever arms as the latter press thereagainst In the embodiment of the invention illustrated, the slotted, hook-like discof the locking assembly is formed with a depending plug-like stub or rod-like shaft section adapted for insertion into to be secured in an axial opening or hosel formed in the shaft-like sector of the putter head.

At its upper end the yoke of the assembly is formed with an upwardly-extending, plug-like shaft projecting into and firmly secured in a mating, bore-like passage in the shaft of the club.

In a preferred embodiment of the invention the threaded shaft which extends through the plates of the yoke and through the slotted disc is formed with a flattened head for entry into the slot-like opening between the arms of the locking lever. The flattened head is formed with a transverse bore through which the pivot pin of the locking lever assembly passes, hingedly to connect the arms of the locking lever to the threaded shaft.

It is a practical and attractive feature of the putter of the present invention that the club head may be quickly and conveniently removed and replaced with a substitute head, with its own stub shaft and its own surmounting disc-like hook.

Other and further objects, features and advantages of the invention will be evident upon a reading of the following detailed description considered in conjunction with the drawings.

DETAILED DESCRIPTION OF THE ILLUSTRATED EMBODIMENT

The aims, objects and advantages of the invention are achieved by providing, in a golf putter, a simple assembly by means of which the head of the club may be simply and quickly pivoted upwardly and adjusted, to provide, selectively, a preferred or desired angle of the club head with respect to the shaft of the club, in a vertically-extending plane.

A further option available, in accordance with the practice of the present invention, is the rapid and simple substitution or replacement of the club head of the putter.

The invention is characterized in that the adjustment of the angle of the club head, and/or the replacement of the head itself is carried out simply and quickly without the need for any tools. This advantageous capability is made possible through the employment of a pivotal connection utilizing a yoke into which a hook-like disc is slideable inserted. Compressive forces generated by means of a camming locking lever urge the jaws or arms of the yoke toward one another to clamp and secure the disc and the club head attached thereto, at a selectable, preferred angle. The locking assembly of the invention includes a threaded shaft to which the locking lever is connected. The threaded shaft, which extends through the yoke and the sandwiched disc, is effectively adjustable in length to control tile clamping pressure generated in the system.

Figure 1:
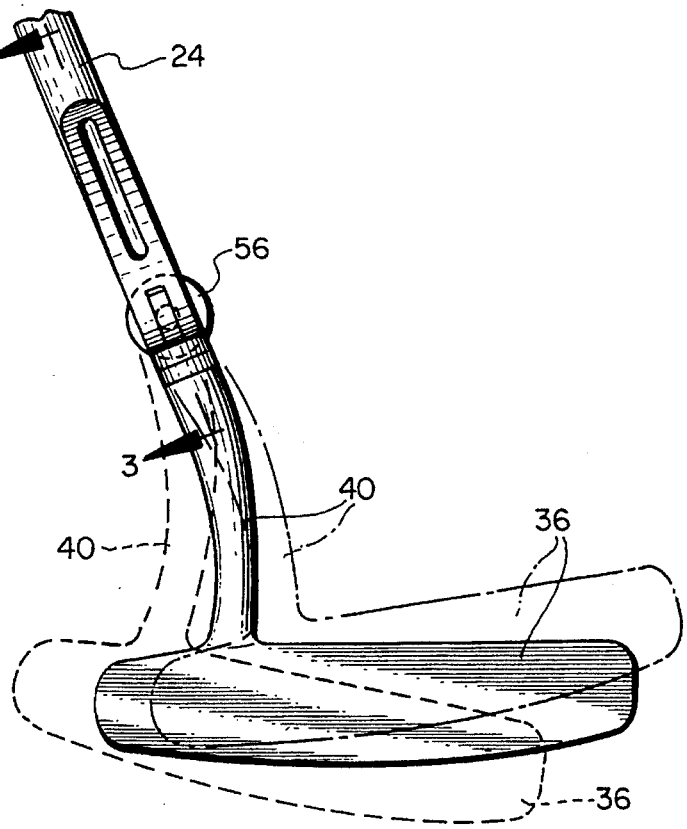
FIG. 1 is a fragmentary, side=elevational view showing the lower end of a club shaft with a putter head pivotally connected thereto, inaccordance with the present invention.
Figure 2:
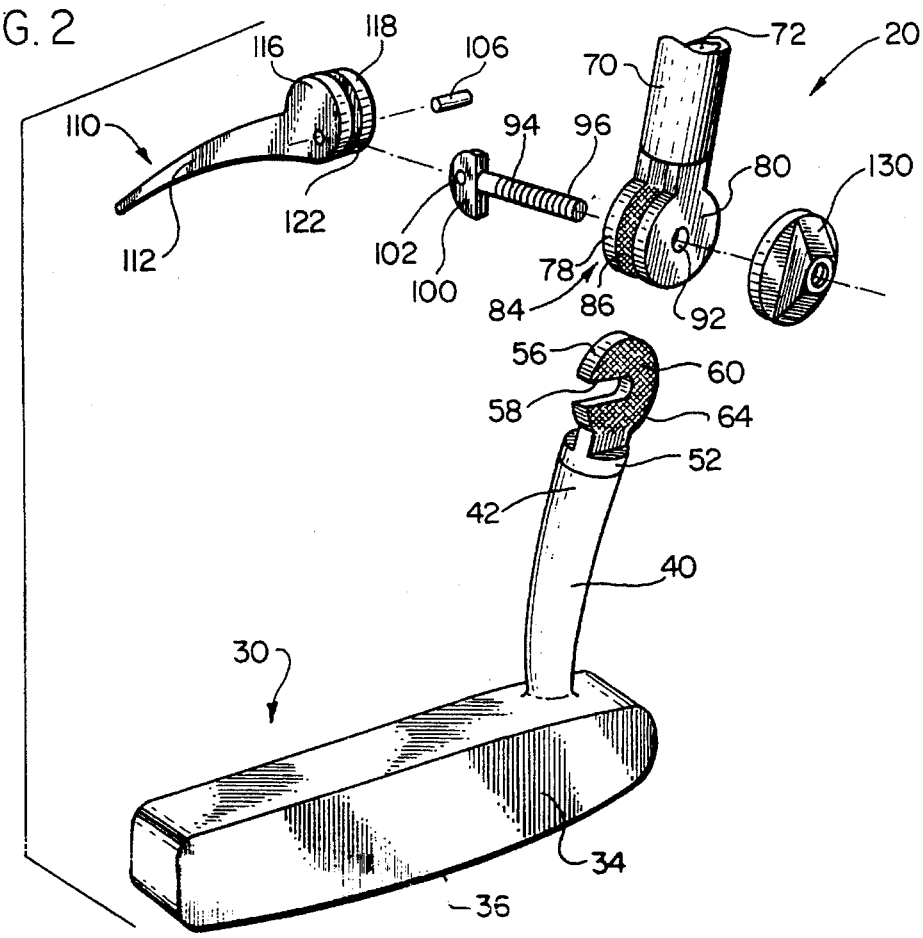
FIG. 2 is an exploded view showing, schematically, how the various components of the invention are assembled for use.

Referring now to the drawings, there is shown, for illustrative purposes and not iny limiting sense, a preferred embodiment of the linkage and locking mechanism by which the head of a golf putter is adjusted angularly, and locked in selectable attitudes. Referring now to FIGS. 1 and 2, a golf club of the type in which a coupling assembly 20 of the present invention finds utility, includes a club shaft 24 and a putter head 30. The club head 30 has a generally planar, vertical, ball-striking face 34 and a slightly curved, convex undersurface 36. A stub shaft 40, integral with the club head 30, is formed at an upper end thereof with a tubular section defining a hosel or opening 46 which is co-axial with the stub shaft. 40. As indicated in FIG. 2, and as shown in FIGS. 3 and 4, sleevedly seated and secured within the cylindrical opening 46 of the putter head 30 is a neck-like pedestal 50 surmounted by a circular collar 52.

Integral with and extending upwardly of the collar 52 is a disc 56 disposed in a plane generally paralleling a plane in which the srtiking face 34 of of the club head 30 lies. The disc 56 is formed with a horizontal slot 58 opening laterally, and forwardly, with reference to the club head 30. Opposed faces 60 of the disc 56 are formed with mechanical irregularities 64 or grid-defining strata or deformations, or striations the utility of which will be evident as the description proceeds.

Figure 3:
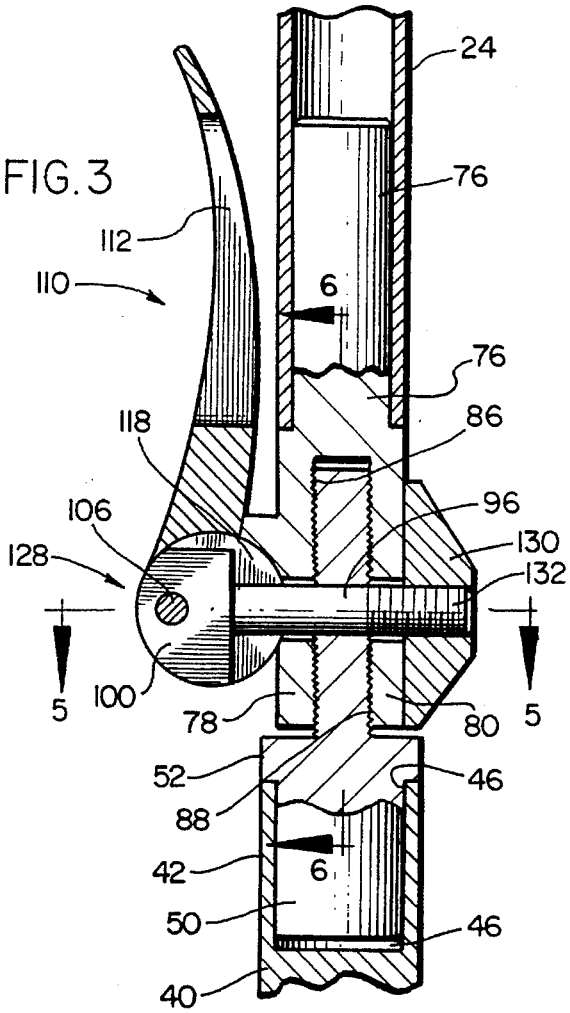
FIG. 3 is a vertical, cross-sectional view taken substantially on the lines 3—3 of FIG. 1 and showing the joinder of a stub shaft element of the putter to a lower end of the club shaft, and depicting the cam and control lever of the assembly in a locking mode.
Figure 4:
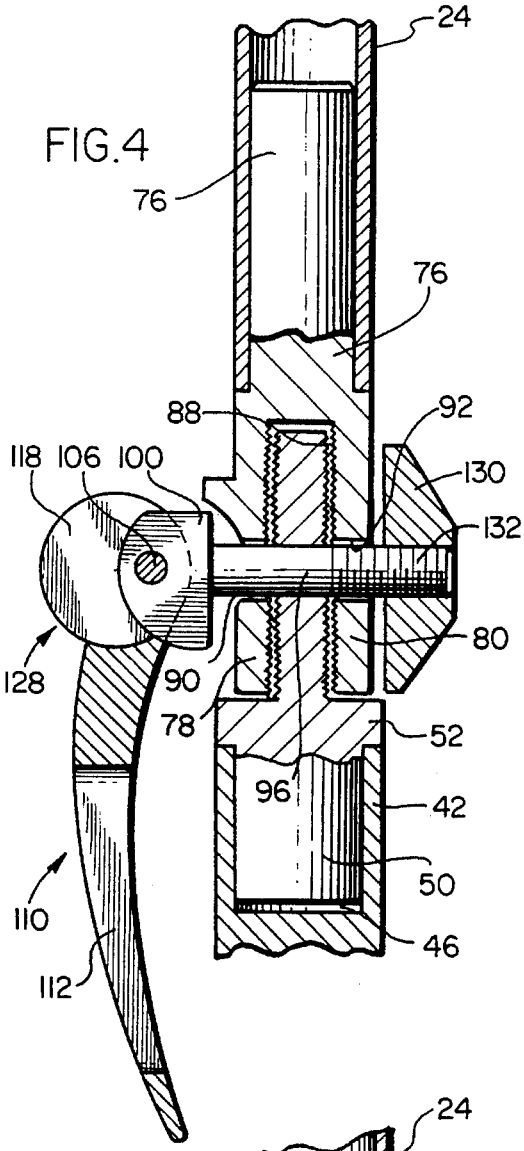
FIG. 4 is a view similar to FIG. 3, but showing the cam-controlling lever in a loosened or unlocked mode.
Figure 5:
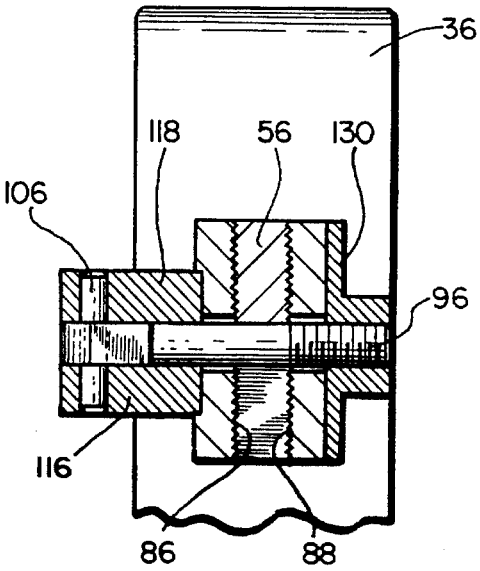
FIG. 5 is a cross-sectional view taken substantially on the lines 5—5 of FIG. 3 and showing the club-head-surmounting disc of the putter head locked in place between the plate-like arms of the yoke secured in the club shaft.
Figure 6:
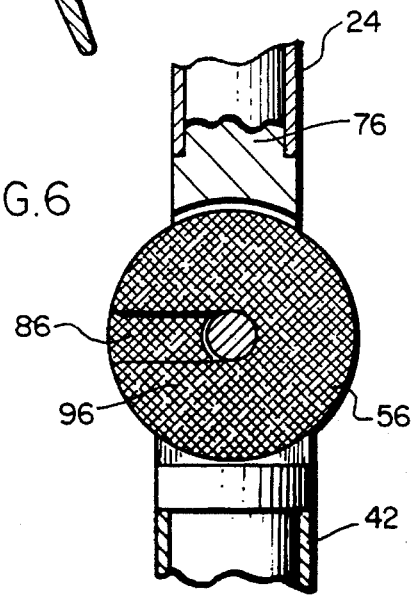
FIG. 6 is a cross-sectional view taken substantially on the lines 6—6 of FIG. 3 and showing, schematically, the disc of the stub shaft of the putter head stressingly abutting a plate of the club-shaft-carried yoke, and the surface irregularities for enhancing the stability of the clamped, locked assembly.

As shown in FIGS. 2, 3 and 4, the club shaft 24 is formed at its lower end 70 with an axial opening 72 into which there is received a rod-like segment 76 formed with integral, downwardly-projecting, laterally-spaced, parallel arms or plates 78 and 80 defining a yoke 84. In a preferred embodiment of the invention, the inner, facing faces or surfaces 86 and 88 of the arms 78 and 80 of the yoke 84 are roughened or "textured", or scored or cross-hatched so as to embrace and to lock more reliably and positively with the disc 56 when the latter is compressively tensioned or gripped therebetween, as indicated in FIGS. 3, 4 and 5.

The arms 78 and 80 of the yoke 84 are formed with centered, through bores 90 and 92 for receiving therethrough a threaded 94 rod 96 having a flattened head 100 formed with a through bore 102 for passage of a pivot pin or hinge pin 106 therethrough. Other elements of the assembly 20 include a locking lever 110 having an elongate body or handle 112 terminating at one end in aligned, spaced, registering parallel flat arms 116 and 118 defining an endwise-opening slot-like recess 122 for slideable receiving therewithin the flattened head 100 of the bolt or rod 96.

The hole 102 in the flattened head 100 is brought into allignment or registry with the through holes 122 and 124 formed in the arms 116 and 118 in the camming assembly 128 so that thje pivot pin 1066 passes through the hole 102 in the flattened head 100 and through the holes 90 and 92 in the arms 116 and 118 to intercouple these components of the assembly 128. Conveniently, the pin 106 is secured as a "press fit". Alternatively, it may be peened or otherwise secured in place.

In completing the asssembly, the shaft of the threaded rod 96 is guided through the alligned holes in the plates 78 and 80 of the yoke 84, and a tensioning nut 130 is threade onto the end 132 of the rod 96. The slotted 58 hook-like disc 56, attached to the club head 30, is positioned to enter the channel-like opening 58 between the spaced arms 78 and 80 of the yoke 84 so that the disc 56 engages the threaded rod 96 as the latter passes through the slot 58 in the disc 56.

Referring now to FIG. 4, the assembly 20 is shown in a release or unlocked mode. No pressure is being applied laterally against the arms 78 and 80 of the clamping yoke 84. The handle 112 of the locking lever 110 extends downwardly, and the arms 116 and 118 of the locking lever 110 are spaced from the yoke 84 and impress no assembly-locking forces against the yoke 84.

As clearly shown in FIGS. 3 and 4, the handle-controlled arms 116 and 118 of the locking lever 110 are connected eccentrically on the head 100 of the head 100 of the locking bolt 96. As the handle 112 of the locking lever 110 is rotated clockwise from the position shown in FIG. 4, to the position shown in FIG. 3, the arms 117 and 118 of the locking lever 110 pivot about the pin 106 to move toward and to engage and bear upon the arm 78 of the yoke 84 and draw the tensioning nut 130 against the other arm 80. The effect is to compress the yoke arms 78 and 80 against the sandwiched disc 56, The assembly assumes a locked mode. Should more compression force be required to ensure locking and rigidity in the assembly, the effective length of the bolt 96 can be shortened by advancing the tensioning nut 130 further along the bolt 96.

In the particular embodiment of the inventioned illustrated, the outer surface of the yoke plate 78 against which the arms 116 and 118 are brought to bear is formed with a crater-like recess or hollow to provide a guide and seat for the stress-impressing elements of the assembly 128.

What is claimed is:

1. A golf club having an elongate shaft and a head, and being useful as a putter, said head having a face for presentation to a golf ball, and an upwardly extending stub shaft, said club including coupling means for pivotally attaching said head to said shaft and for firmly and positively locking said head to extend at selectable vertical angles to meet specific needs and preferences of a golfer, said coupling means comprising interengaging components including a first component carried by said head at an upper end of said stub shaft thereof, and a second component carried by said elongate shaft of said club at a lower end thereof, said stub shaft of said club head being formed at an upper extremity thereof with a plate-like, upwardly-projecting disc extending in a plane generally paralleling said face of said club head, said disc being formed with a horizontal slot opening laterally of said disc, said elongate shaft of said club carrying at a lower extremity thereof a yoke including first and second vertically-extending plates spaced from and parallel to one another to define a slot-like recess therebetween for receiving said plate-like disc of said club head in close engagement therewithin, said plates of said yoke being formed with aligned transverse bores extending transversely therethrough in a central zonal area thereof, double-ended bolt means extending through said bores in said plates of said yoke, said bolt means being formed at a first end thereof with threads, a digitally manipulable and adjustable tensioning nut threadedly engaged on said bolt means at said threaded first end thereof, a second end of said bolt means being formed to define a flattened head having a bore extending transversely therethrough for accommodating a pin, a locking lever including an elongate rod-like body and being formed at an end thereof with spaced, parallel, flat arms defining an endwise-opening, slot-like recess for slidably receiving said flattened head of said bolt therewithin, said plate-like disc of said stub shaft of said club head being disposed to enter between said plates of said yoke to receive said bolt means within said slot formed in said plate-like disc, said arms of said lever including at said end thereof arcuately contoured camming edge surfaces for abuttingly and stressingly engaging against an outer lateral face of said yoke, said arms of said lever being formed with off-set bores remote from said camming edge surfaces and extending transversely through said arms for registering alignment with said bore in said bolt means, a pivot pin extending through said arms of said lever and through said head of said bolt means, said lever being positionable about said pivot pin to assume, selectively, a first position in which said lever exrends generally ouwardly from said elongate shaft of said club, to a locking, second position in which said lever overlies said elongate shaft, said lever being operative through camming action of said lever to impress forces laterally against said yoke to effect a positive locking engagement of said disc of said club head between said plates of said yoke to retain said club head fixed at a selectable vertical angle with respect to said elongate shaft of said club.

2. A golf club as set forth in claim 1 and further comprising an array of definitive mechanical surface irregularities formed on each of a pair of opposed faces of said disc of said stub shaft of said club head, and cooperating interengaging physical irregularities formed on faces of said plates of said yoke presented to said disc, said interengaging mechanical irregularities on said disc of said club head and said plates of said yoke constituting means for preventing rotative physical movement of said disc with respect to said plates when said lever is disposed in an elected locked position.

3. A golf club as set forth in claim 1 wherein said tensioning nut carried on said bolt means comprises means for adjusting an effective-functional, length of said bolt means for regulating compression forces applied to said plates said yoke upon actuation of said lever arcuately.

4. A golf club as set forth in claim 1 wherein said pivotal lever is mounted on said pivot pin eccentrically to bring said edge surfaces of said lever into increasing degrees of positive stressing abutment against a,top surface of one of said plates of said yoke presented thereto, and simultaneously to exert through said bolt means pulling force applied to said tensioning nut, and through said tensioning nut against an abutment surface of a second of said plates of said yoke, thereby to enhance sandwiching compression forces applied against said disc of said club head at opposed faces thereof, and positively to preclude relative movement of said plates of said yoke and of said club head disc interposed therebetween.

5. A golf club as set forth in claim 1 wherein said elongate body of said lever is arcuate to define a convex surface thereof presented to said shaft of said club when said lever overlies to extend along said shaft of said club in a locking mode of said lever.

6. A golf club as set forth in claim 1 wherein with said lever disposed in a locking mode, a free end of said lever is disposed radially outwardly of said shaft of said club to facilitate digital grasping of said lever to pivot said lever and thereby to remove compression forces from said disc sandwiched in said yoke.

7. A golf club as set forth in claim 1 wherein said said face of said yoke against which said lever exerts compressive forces is concave in configuration for nestingly engaging a convex curved edge surface of said pivotal lever.

* * * * *